US009908036B1

(12) United States Patent
Pamukchiev et al.

(10) Patent No.: US 9,908,036 B1
(45) Date of Patent: Mar. 6, 2018

(54) METHOD AND DEVICE FOR CONDUCTING A ROULETTE GAME

(76) Inventors: Viktor Pamukchiev, Henderson, NV (US); Ralitsa Pamukchieva, Henderson, NV (US)

( * ) Notice: Subject to any disclaimer, the term of this patent is extended or adjusted under 35 U.S.C. 154(b) by 0 days.

(21) Appl. No.: 12/851,419

(22) Filed: Aug. 5, 2010

Related U.S. Application Data

(60) Provisional application No. 61/273,716, filed on Aug. 6, 2009.

(51) Int. Cl.
*A63F 5/00* (2006.01)
*G07F 17/32* (2006.01)

(52) U.S. Cl.
CPC ..... *A63F 5/0035* (2013.01); *G07F 17/3213* (2013.01)

(58) Field of Classification Search
CPC .. A63F 5/00; A63F 5/005; A63F 5/001; A63F 5/0017; A63F 5/0023; A63F 5/0029; A63F 5/0035; A63F 5/0041; A63F 5/0047; A63F 5/0052; A63F 5/0058; A63F 5/0064; A63F 5/007; A63F 5/0076; A63F 5/0082; A63F 5/0088; A63F 5/0094; A63F 5/02; A63F 5/04; A63F 5/041; A63F 5/043; A63F 5/045; A63F 5/046; A63F 5/048; G07F 17/32; G07F 17/3213; G07F 17/3286
USPC ..... 463/17, 22; 273/138.1, 139, 273/142 E–142 G, 145 D, 145 E, 146
See application file for complete search history.

(56) References Cited

U.S. PATENT DOCUMENTS

| | | | | |
|---|---|---|---|---|
| 1,036,591 | A * | 8/1912 | Eliscu | 273/142 E |
| 2,831,692 | A * | 4/1958 | Keast | 273/145 E |
| 3,608,905 | A * | 9/1971 | Edison | 273/146 |
| 5,540,442 | A * | 7/1996 | Orselli et al. | 463/17 |
| 7,396,013 | B2 * | 7/2008 | Ito et al. | 273/269 |

* cited by examiner

*Primary Examiner* — Jasson Yoo

(57) ABSTRACT

A device for conducting a roulette game includes a rotatable wheel with a plurality of pockets each associated with a game indicium and a selector having at least one face with a payout indicator thereon. Wagers are received from players on the outcome of a spin. The selector is propelled into a rotating wheel and the game indicium associated with the pocket in which the pocket comes to rest is used to resolve the wagers. The payout indicator on a designated face of the selector determines, at least in part, the payout for certain of the winning wagers.

14 Claims, 9 Drawing Sheets

METHOD AND DEVICE FOR CONDUCTING A ROULETTE GAME

RELATED APPLICATION DATA

The present application claims the priority of U.S. Provisional Application Ser. No. 61/273,716, entitled "Method and Device for Conducting a Roulette Game," filed Aug. 6, 2009 by Applicants herein.

FIELD OF THE INVENTION

The present invention relates to wagering games. More specifically, the present invention is a method and device for conducting a roulette game in which the selector includes a face that determines the payout for winning wagers.

BACKGROUND OF THE INVENTION

Roulette is a well known casino game played using a rotatable roulette wheel with pockets or canoes around its periphery. Each pocket is separated from an adjacent pocket by a separator or fret. The pockets are marked with numbers 1-36 with an additional pocket for 0 in the European version and two additional pockets for 0 and 00 in the American version. Each of the numbers 1-36 is colored either red or black such that eighteen of the numbers are red and eighteen are black. The numbers 0 (and 00, in the American version) are usually colored green so that they can be distinguished from the red and black numbers.

The wheel axis is mounted on a gaming table covered with a layout having areas marked with numbers corresponding to the numbers on the roulette wheel. The areas for the numbers one through thirty-six are arranged in a matrix of twelve rows (or streets) by three columns. Thus, each row (or street) includes three numbers and each column includes twelve numbers. Areas for the 0 (and 00, in the American version) are positioned at one end of the matrix of numbers. By positioning chips inside numbered wagering areas or along borders or intersections of numbered wagering areas, players may place wagers on one or more numbers. For example, a split wager on two numbers is placed on the line separating the two numbers; a trio wager on three numbers is placed on the intersection of three numbers (typically, only the 0, 1, 2 areas and the 00, 2, 3 areas are laid out for placement of a trio wager); and a corner wager on four numbers is placed on the intersection of four numbers. The layout also includes proposition wagers on sets of multiple numbers such as: odd numbers; even numbers; black numbers; red numbers; high numbers; low numbers; numbers by dozen (e.g. first twelve numbers or 1-12, second twelve numbers or 13-24, and third twelve numbers or 25-36); numbers within a street; and numbers within a column.

To play the game, players place chips on one or more wagering areas and a ball is launched into the spinning roulette wheel. The ball eventually comes to rest in a pocket to define the winning number and proposition wagers. Players are rewarded based on the nature of the wager placed. A winning number wager is typically rewarded at 35 to 1; winning split wagers are typically rewarded at 17 to 1; winning street wagers and trio wagers are typically rewarded at 11 to 1; winning corner wagers are typically rewarded at 8 to 1; winning dozen and column wagers are typically rewarded at 2 to 1; and winning odd, even, black, red, high, and low wagers are typically rewarded at even money.

Drawbacks of table or "live" roulette are that (1) the number and nature of winning propositions are limited and (2) there exists no mechanism to offer a large jackpot.

SUMMARY OF THE INVENTION

A device for conducting a wagering game for at least one player includes a wheel having a plurality of pockets, each of which is associated with a game indicium, such as a number. The pockets are shaped to receive a polygonal selector. Optionally, the wheel is mounted to a game table such that the wheel is rotatable with respect to the game table.

A device also includes a polygonal selector. In an optional embodiment, the polygonal selector is a regular dodecahedron, i.e. a polygonal solid having twelve pentagonal faces. At least one of the faces of the polygonal selector includes a payout indicator. The payout indicator determines, at least in part, the payout for a wager on the game indicium associated with the pocket in which the polygonal selector lands.

A wagering layout may be provided for players to indicate wagers. The wagering layout optionally includes wagering areas for each game indicium and/or groups of game indicia. In such an optional embodiment, wagers may be received from the player on the wagering layout, with the location of the wager indicating the game indicium or game indicia wagered upon.

A method of conducting a wagering game includes receiving wagers from one or more players with each wager designating a game indicium or a group of game indicia. After receiving wagers, a game indicium is randomly selected using the wheel and the polygonal selector. Optionally, this step of selecting includes spinning the wheel and introducing the polygonal selector into the spinning wheel. The pocket of the wheel in which the polygonal selector comes to rest is the selected game indicium. A reward is issued to any player who wagered upon the selected game indicium or a group including the selected game indicum. The reward is determined, at least in part, based on the payout indicator, if any, on a designated face of the polygonal selector resting in the pocket of the selected game indicium. For example, in one optional embodiment, the payout indicator is a multiplier and the reward for a winning wager is the product of the player's wager and the payout indicator, if any, displayed on the upward face of the polygonal selector.

DESCRIPTION

Figure 1:
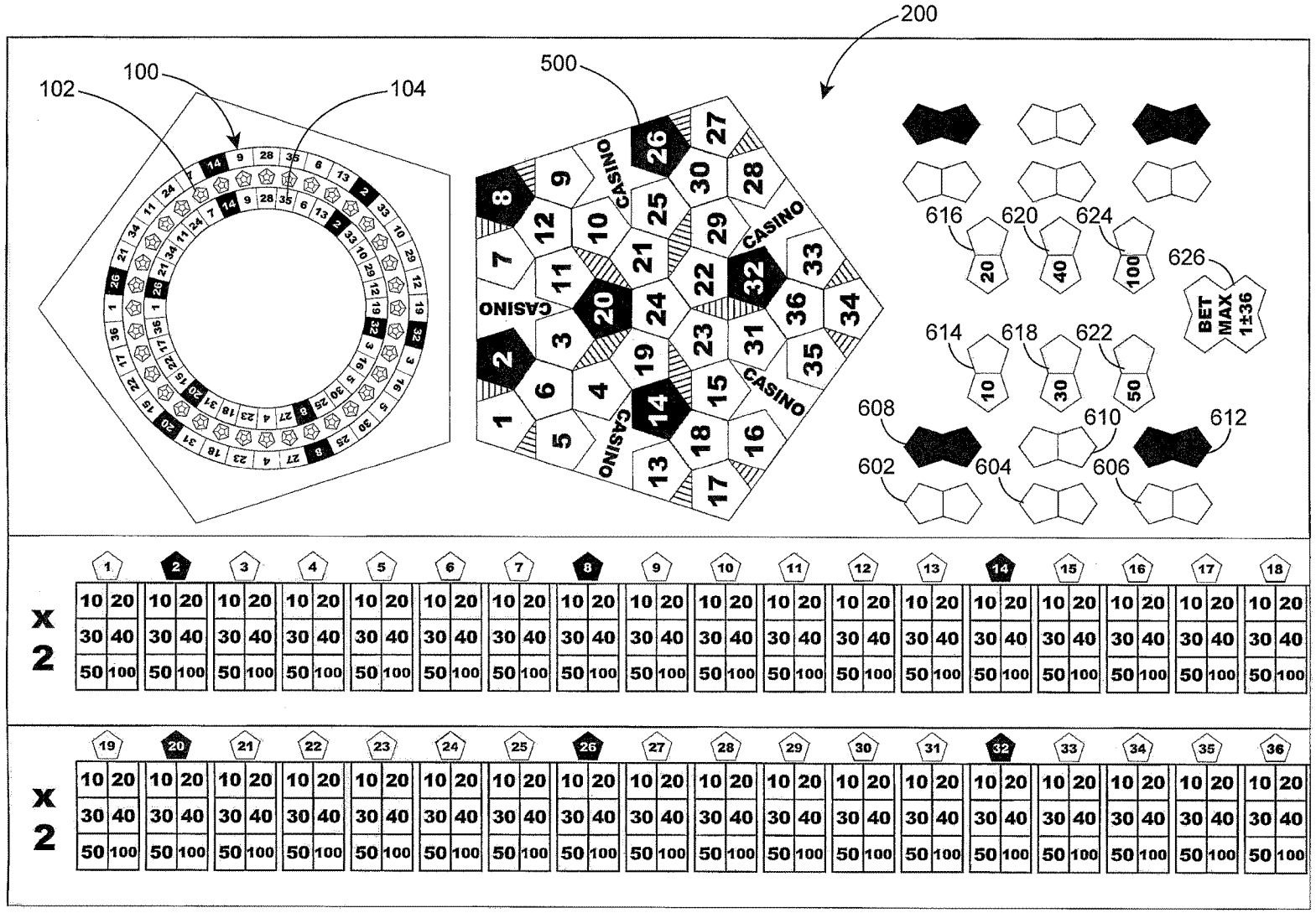
FIG. 1 is a top view of a wheel and wagering layout according to an embodiment of the present invention.
Figure 2:
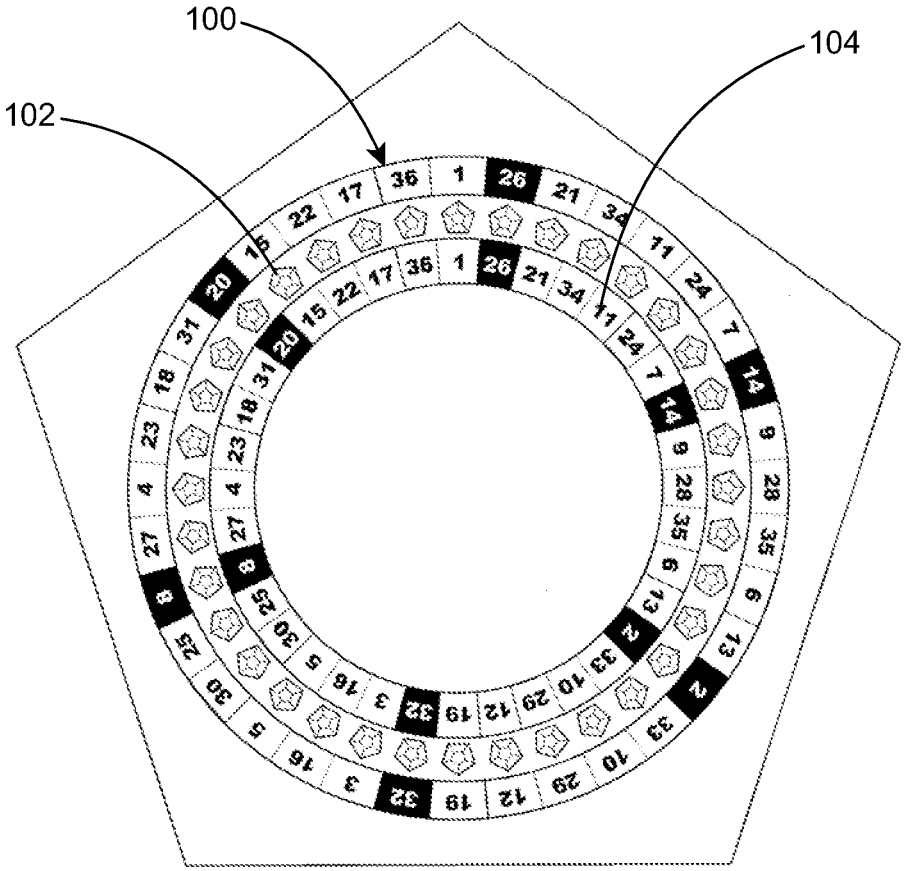
FIG. 2 is a top view of a wheel according to the embodiment of FIG. 1.
Figure 3A:
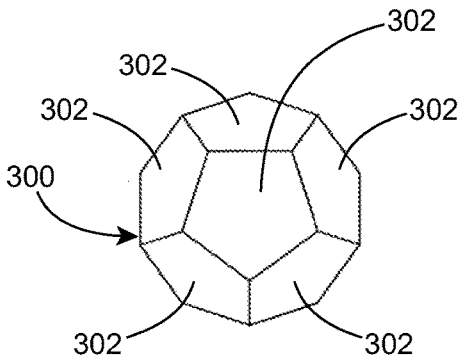
FIG. 3A is an end view of a polygonal selector according to an embodiment of the present invention.
Figure 3B:
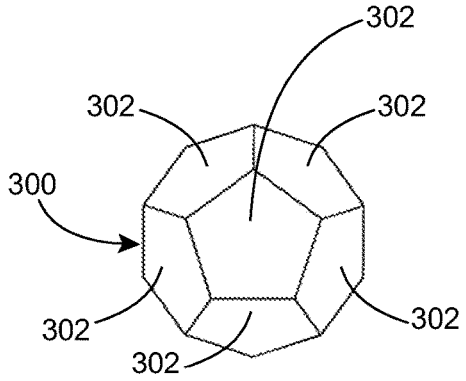
FIG. 3B is an end view of a polygonal selector opposite to the end view of FIG. 3A.
Figure 3C:
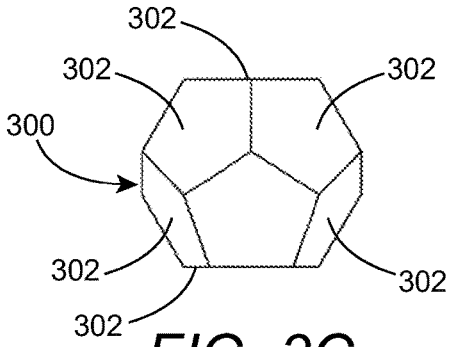
FIG. 3C is a side view of a polygonal selector according to the embodiment of FIG. 3A.
Figure 3D:
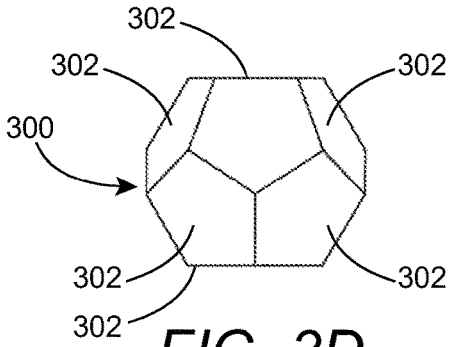
FIG. 3D is a side view of a polygonal selector opposite to the side view of FIG. 3C.
Figure 3E:
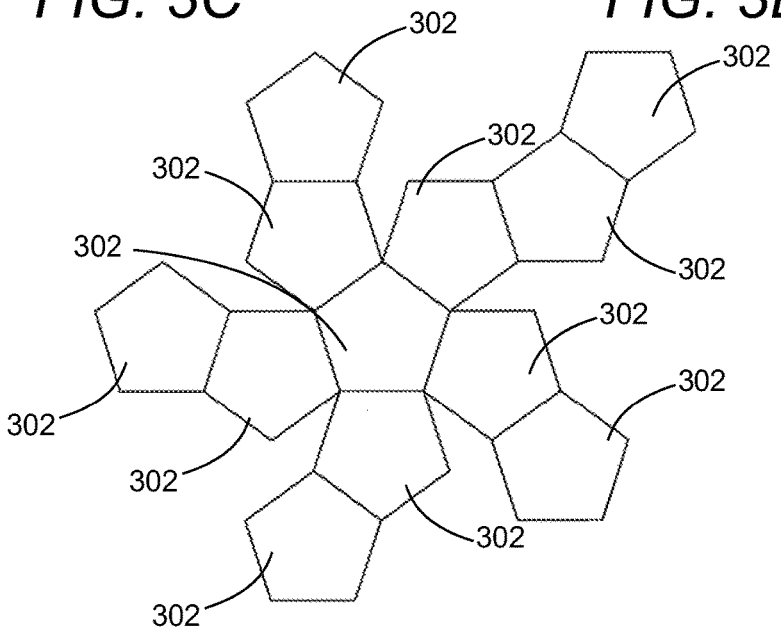
FIG. 3E is a top plan view of a polygonal selector according to the embodiment of FIG. 3A.
Figure 9:
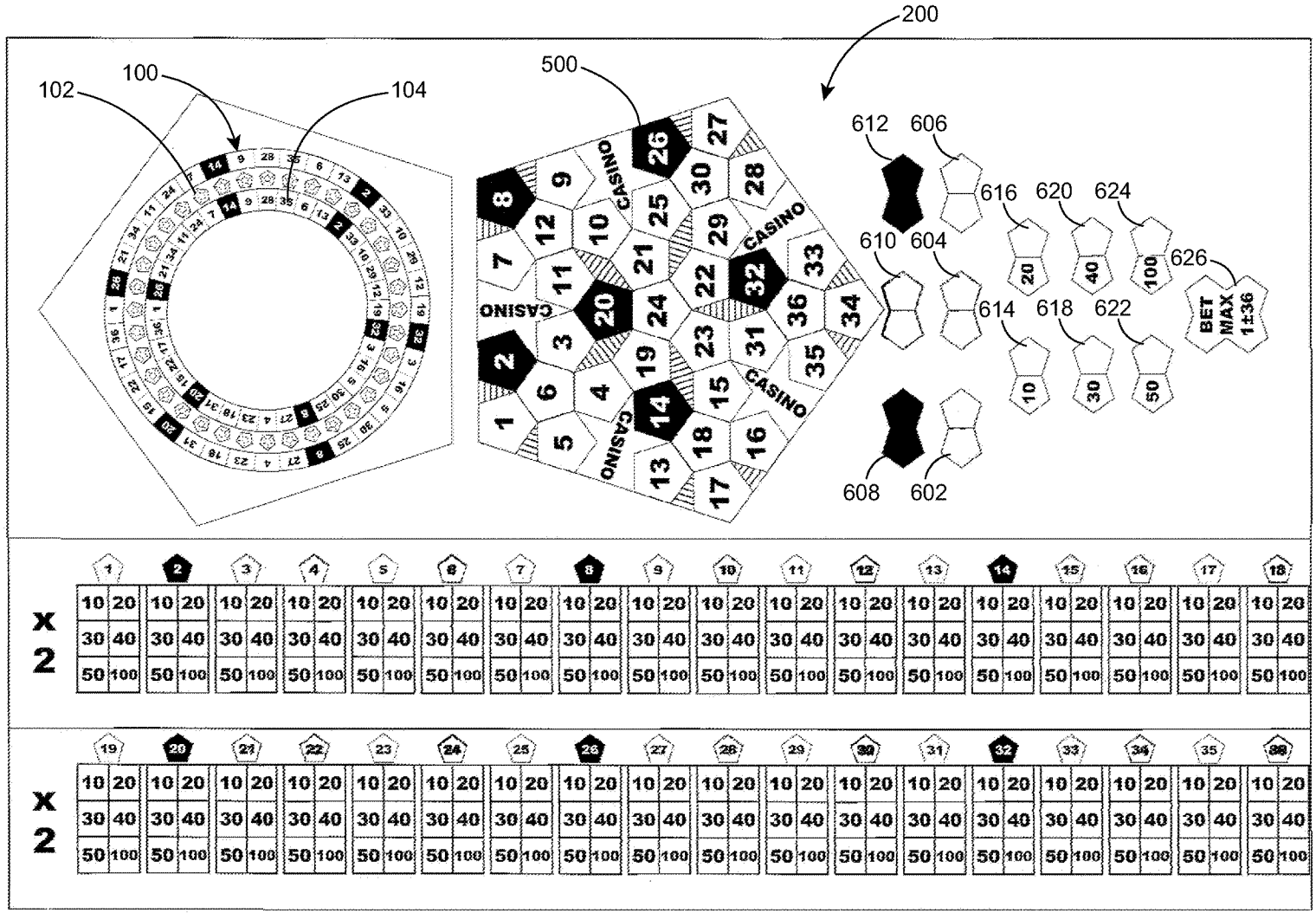
FIG. 9 is a top view of a wheel and wagering layout according to an embodiment of the present invention.

Reference is now made to the figures wherein like parts are referred to by like numerals throughout. Referring first to FIGS. 1, 2, and 9, an embodiment of the present invention includes a device for conducting a roulette game. It is contemplated that the device may include physical objects or may include electronic representations of physical objects. For example, a device may include a wheel 100 or a display showing a computer-generated representation of a wheel 100. Similarly, a device may include a wagering layout 200 or a display showing a computer-generated representation of a wagering layout 200. Referring to FIGS. 3A-3E, a device may include a selector 300 that interacts with a wheel 100 or display programmed to show a computer-generated representation of a selector 300 that interacts with a computer-generated representation of a wheel. It is contemplated that an electronic or computer device according to an embodiment of the present invention may take any form, including a gaming machine, personal computer, handheld device, cellular telephone, PDA, kiosk, or any other form. Although the examples given below may describe an embodiment of the present invention as if the device were physical, these examples should be interpreted to apply to any form of the device including electronic forms of the device.

A wheel 100 is provided with a plurality of pockets 102 each of which is associated with a game indicium 104. In the optional embodiment of FIGS. 1, 2, and 9, the wheel 100 includes thirty-six pockets 102 and the game indicia 104 associated with the pockets 102 are the numbers one through thirty-six. It is contemplated that any quantity of game indicia 104 may be used and that the game indicia may take any form (for example, letters, numbers, symbols, and so forth) in alternate optional embodiments. The game indicia 104 may be arranged in any order. In the optional embodiment illustrated, the game indicia 104 are, in clockwise order: 1, 26, 21, 34, 11, 24, 7, 14, 9, 28, 35, 6, 13, 2, 33, 10, 29, 12, 19, 32, 3, 16, 5, 30, 25, 8, 27, 4, 23, 18, 31, 20, 15, 22, 17, 36.

In addition to game indicia 104, each pocket 102 may be associated with a secondary indicium. The secondary indicium may take any form. For example, in the optional embodiment of FIGS. 1, 2, and 9, each pocket 102 is associated with a color in addition to a number. As discussed in greater detail below, the inclusion of secondary indicia for the pockets in an optional embodiment may provide for additional wagering options. It is contemplated that any quantity of secondary indicia, that is, colors, may be included. In the optional embodiment, six colors are included. Table 1 illustrates the colors associated with the numbered pockets as shown in the example device of FIGS. 1, 2, and 9.

TABLE 1

| Color | Numbered Pockets |
|---|---|
| Yellow | 1, 7, 13, 19, 25, 31 |
| Black | 2, 8, 14, 20, 26, 32 |
| Blue | 3, 9, 15, 21, 27, 33 |
| Green | 4, 10, 16, 22, 28, 34 |
| White | 5, 11, 17, 23, 29, 35 |
| Red | 6, 12, 18, 24, 30, 36 |

With continued reference to FIGS. 1, 2, and 9, the wheel 100 may, in an optional embodiment, be generally circular and rotate about an axis perpendicular to the center of the wheel 100. The rotation of the wheel 100 may be initiated by hand or with the aid of a mechanical drive. Similarly, the rotation of the wheel 100 may be stopped due strictly to the friction in the axis about which the wheel 100 rotates or a mechanical brake may be provided. As previously mentioned, the wheel 100 may also be computer-generated, with the spinning of the wheel 100 illustrated through computer animation.

The wheel 100 may include two concentric rows of game indicia 104 that surround a row of pockets 102. Referring generally to FIGS. 1-3, optionally, the pockets 102 are formed to receive a selector 300. Thus, in the optional embodiment illustrated in FIGS. 1-3, a selector 300 may have pentagonal face 302 and the pockets 102 may have a pentagonal indentation to receive a pentagonal face 302 of the selector 300. As may be appreciated, where the selector 300 has a different shape, the shape of the pockets 102 may be altered in accordance with the shape of the selector 300.

Turning to FIGS. 3A-3E, a selector 300 includes at least one face 302. In an optional embodiment, the selector 300 is a solid polygon. As may be appreciated, the selector 300 may take the form of any solid polygon. In the optional embodiment of FIGS. 3A-3E, the selector 300 is a dodecahedron, that is, a regular solid polygon with twelve pentagonal faces 302. In an optional embodiment, the edges and vertices of the selector 300 may be rounded to smooth the rolling movement of the selector 300. The selector 300 may be formed from any material; optionally the selector 300 is transparent so players can visually verify that the selector 300 is not biased by weights, magnets, or the like.

Figure 4A:
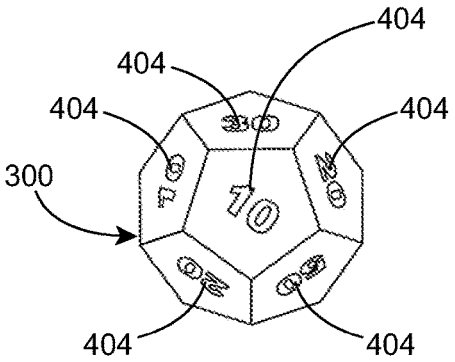
FIG. 4A is an end view of a polygonal selector according to an embodiment of the present invention.
Figure 4B:
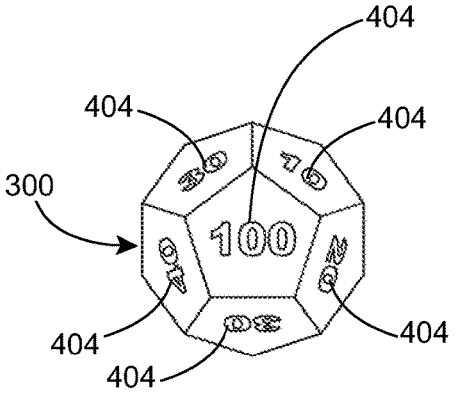
FIG. 4B is an end view of a polygonal selector opposite to the end view of FIG. 4A.
Figure 4C:
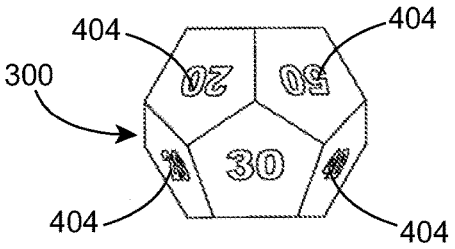
FIG. 4C is a side view of a polygonal selector according to the embodiment of FIG. 4A.
Figure 4D:
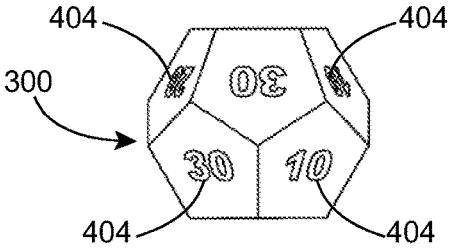
FIG. 4D is a side view of a polygonal selector opposite to the side view of FIG. 4C.
Figure 4E:
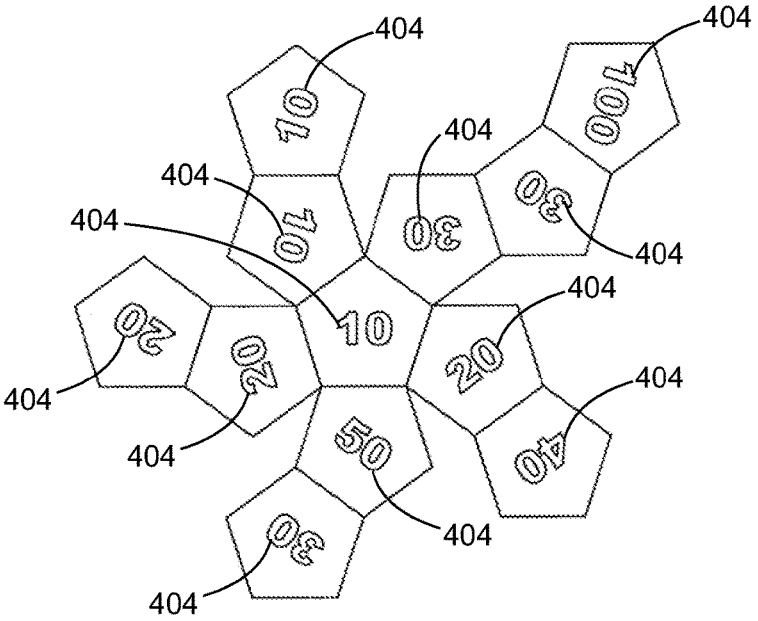
FIG. 4E is a top plan view of a polygonal selector according to the embodiment of FIG. 4A.

Referring to FIGS. 4A-4E, at least one of the faces 302 of the selector 300 includes a payout indicator 404 that, at least in part, determines the payout for a winning wager, as described in greater detail below. The payout indicator 404 may take any form. For example, the payout indicator 404 may be a multiplier, a fixed amount, an added bonus, a subtracted penalty, or the like. The payout indicators 404 may, consequently, take many different forms. In the example of FIGS. 4A-4E, the payout indicators 404 are multipliers. The function of the multipliers is explained in greater detail below. In the optional embodiment of FIGS. 4A-4E, the payout indicators 404 on the faces 302 of the selector 300 are: 10, 20, 30, 40, 50, and 100. As shown in FIG. 4A, the payout indicators 404 as viewed from one end may include 10 at the end face 302, with 30, 20, 50, 20, and 10 on the surrounding faces 302. As shown in FIG. 4B, the payout indicators 404 as viewed from the opposite end as FIG. 4A may include 100 at the end face 302, with 10, 20, 30, 40, and 30 on the surrounding faces 302. It is contemplated that these payout indicators 404 are only illustrative and that the payout indicators 404 may differ in alternate optional embodiments.

Similarly, since the selector 300 of FIGS. 4A-4E includes six different payout indicators 404 and twelve faces 302, the selector 300 in this optional embodiment includes faces 302 with duplicate payout indicators 404. For example, the payout indicators 404 of 10, 20, and 30 each appear on three faces 302, whereas the payout indicators 404 of 40, 50, and 100 only appear on one face 302 each. It is contemplated that the distribution of the payout indicators 404 may differ in alternate optional embodiments.

Additionally, in this optional embodiment, each face 302 includes a payout indicator 404. However, it is contemplated that, in alternate optional embodiments, one or more faces 302 may remain blank. The effect of a blank face 302 may depend on the optional embodiment and may include no payout, a multiplier of one, a push, a varying or wild payout, or any other effect.

Figure 5:
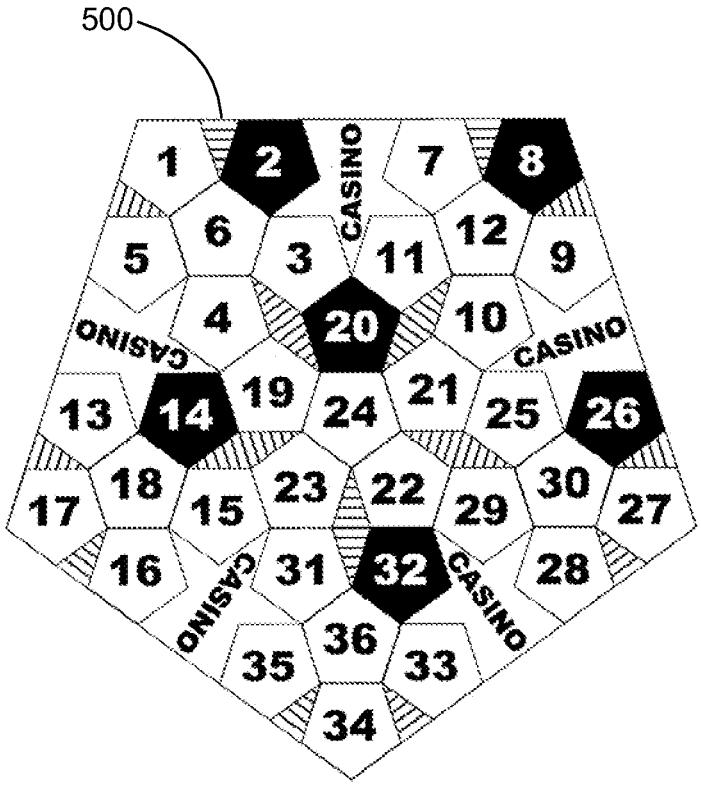
FIG. 5 is a top sectional view of a wagering layout according to the embodiment of FIG. 1.

Referring to FIGS. 1, 5-7, and 9, a wagering layout 200 may be provided. Optionally, all players wager on a shared wagering layout 200. The wagering layout 200 may include a variety of wagering options depending on the game conducted. It is contemplated that wagers may be subject to minimum and maximum limits set by the game operator. In the optional embodiment of FIGS. 1 and 5-7, each pocket 102 is associated with a game indicium 104 (e.g. a number) and a secondary indicium (e.g. a color). The wagering layout 200 may include an numbers wagering area 500 in which the player may designate wagers on numbers, or combinations of numbers, selected by the selector 300. As illustrated in FIGS. 1, 5, and 9, a numbers wagering area 500 may include separate wagering spots for each number appearing on the wheel 100. To receive a wager on a specific number, a player may place the wager amount (or a marker identifying the wager amount) on the area identified for that number. For example, to place a wager that the number 1 will be selected on the wheel 100 by the selector 300, a player may place gaming chips or other wager identifier on the area identified by the number "1."

In a further optional embodiment, wagers may be received on combinations of numbers. In one such optional embodiment, wagers may be placed on the border of an area identified by the numbers wagered upon. For example, to place a wager that the number 7 or 12 will be selected on the wheel 100 by the selector 300, a player may place gaming chips or other wager identifier on the line separating the area identified by the number "7" and the area identified by the number "12." As laid out in the example of FIG. 5, possible combination wagers include: 1 and 6; 2 and 6; 3 and 6; 4 and 6; 5 and 6; 3 and 20; 4 and 19; 7 and 12; 8 and 12; 9 and 12; 10 and 12; 11 and 12; 11 and 20; 10 and 21; 13 and 18; 14 and 18; 15 and 18; 16 and 18; 17 and 18; 14 and 19; 15 and 23; 19 and 24; 20 and 24; 21 and 24; 22 and 24; 23 and 24; 23 and 31; 21 and 25; 22 and 29; 22 and 32; 25 and 30; 26 and 30; 27 and 30; 28 and 30; 29 and 30; 31 and 36; 32 and 36; 33 and 36; 34 and 36; and 35 and 36. It is contemplated that in alternate optional embodiments, the numbers wagering area 500 may be configured differently to provide alternate or additional combination wagers.

Figure 6:
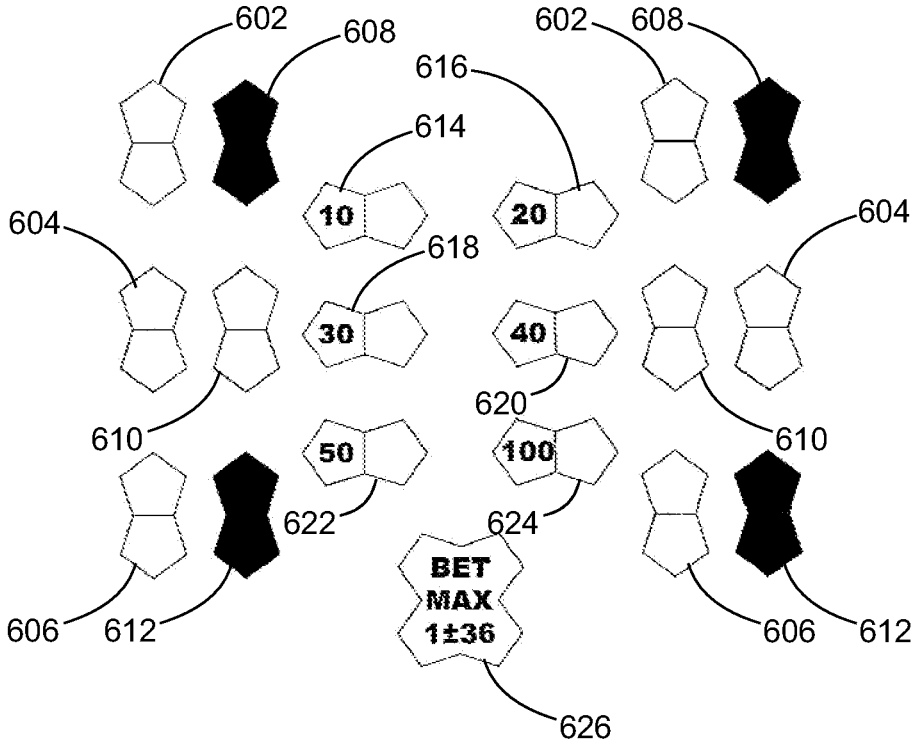
FIG. 6 is a top sectional view of a wagering layout according to the embodiment of FIG. 1.

Referring to FIGS. 1, 6, and 9, a wagering layout 200 may also include areas for wagering on colors, payout indicators, and/or all numbers. In an optional embodiment, a separate area may be provided for receiving wagers on each color. For example, in the optional embodiment of FIG. 6, a yellow area 602, a blue area 604, a white area 606, a black area 608, a green area 610, and a red area 612 may be provided. Optionally, the areas may be colored to identify the color on which the player is wagering. In such an optional embodiment, wagers on a color may be placed in the area 602, 604, 606, 608, 610, 612 identified by that color. For example, a player wagering that a pocket 102 associated with the color red will be selected on the wheel 100 by the selector 300, the player may place gaming chips or other wager identifier on a red area 612.

Wagers may optionally be received on payout indicators. In the optional embodiment illustrated in FIGS. 1, 6, and 9, separate areas 614, 616, 618, 620, 622, 624 may be provided for wagers on each payout indicator 404 appearing on the selector 300. In alternate optional embodiments, it is contemplated that certain payout indicators 404 may not be available for wagering upon. In the example of FIG. 6, a 10 area 614, a 20 area 616, a 30 area 618, a 40 area 620, a 50 area 622, and a 100 area 624 may be provided. To place a wager that a payout indicator 404 will appear on the exposed face 302 of the selector 300, a wager may be placed in the area 614, 616, 618, 620, 622, 624 identified by that payout indicator 404. For example, to place a wager that a 40 payout indicator will appear on the upward face 302 of the selector 300 when it comes to rest in a pocket 102, the player may place gaming chips or other wager identifier on a 40 area 620.

Wagers may optionally be received designating all numbers. In this optional embodiment, a wager designated all numbers is a wager on the payout indicator 404 on the exposed face of the selector 300 regardless of the number selected. For example, in an optional embodiment, a wager on "all numbers" is rewarded if the payout selector 404 is within a first set of payout selectors 404 (such as 40, 50, or 100 in the optional embodiment of FIG. 6). Conversely, at least a portion of a wager on "all numbers" is collected if the payout selector 404 is within a second set of payout selectors 404 (such as 10, 20, or 30 in the optional embodiment of FIG. 6). In the optional embodiment of FIGS. 1 and 6, an area 626 may be provided for wagers on all numbers. For example, in the optional embodiment of FIG. 6, an area 626 marked "BET MAX" may be provided. To place a wager on a set of payout selectors 404 that may be exposed on the upward facing face 302 of the selector 300 when it comes to rest in a pocket 102, a player may place gaming chips or other wager identifier on an area 626 marked "BET MAX." As suggested above, the all numbers wager may be subject to predetermined wager limits. For example, in an optional embodiment, an all numbers wager may be required to be at least thirty-six units, that is, one unit per number. Thus, where the denomination unit is $1, the all numbers wager may be required to have a minimum size of $36.

Figure 7:
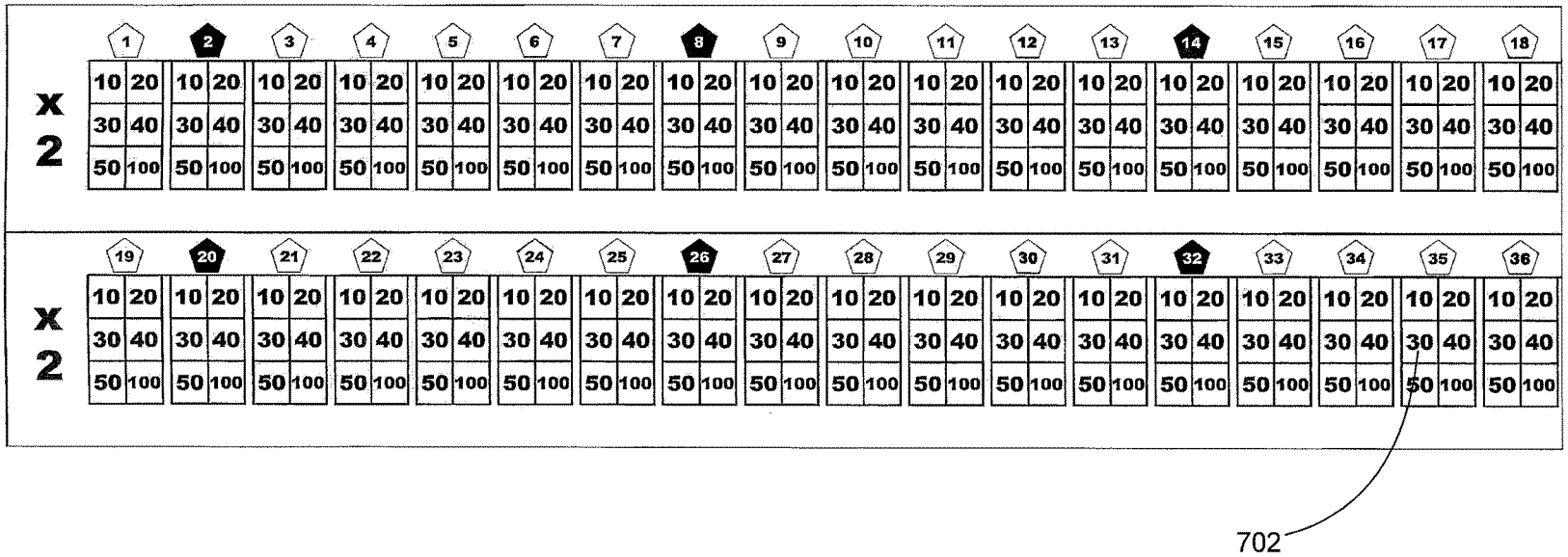
FIG. 7 is a top sectional view of a wagering layout according to the embodiment of FIG. 1.

Referring to FIGS. 1, 7, and 9, players may wager on the game indicium (that is, number) selected in combination with the payout indicator 404 on the exposed upward facing face 302 of the selector 300 when the game indicium is selected. For example, a wagering layout 200 may include a matrix with an area for each possible combination of game indicium (that is, number) and payout indicator 404. To place a wager on a game indicium/payout indicator combination, the player places gaming chips or other wager identifier in the area identifying the combination. For example, to place a wager on a combination of the game indicium 35 and the payout indicator 30, a player may place gaming chips or other wager identifier in the area 702 identified "30" under the game indicium identified "35." Such a wager would be rewarded if the selector 300 falls into the pocket 102 associated with the number 35 and the payout indicator 404 on the upward face 302 of the selector is "30." As discussed in greater detail below, the payout for such a wager may be increased, such as doubled, compared to payouts for single numbers.

Figure 8:
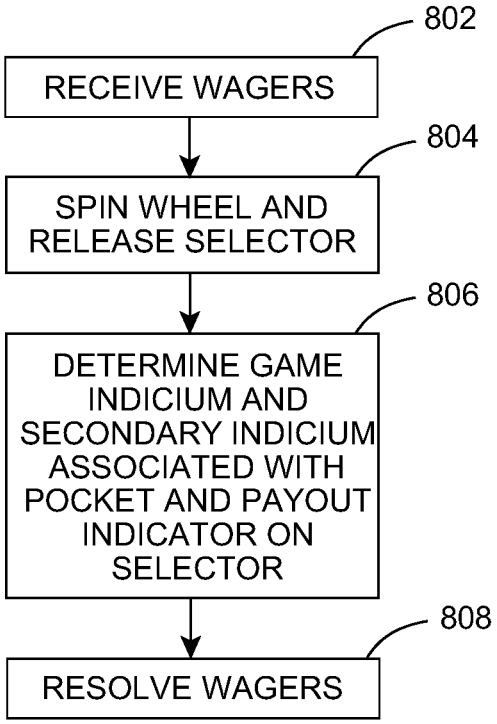
FIG. 8 is a flow chart of a method for conducting a roulette game according to an embodiment of the present invention.

Referring generally to FIGS. 1-7 and 9 and specifically to FIG. 8, a game according to an embodiment of the present invention includes receiving 802 wagers from players. It is contemplated that the game may be conducted like conventional roulette in which a player exchanges currency or casino chips for betting or gaming chips with a color identified for the player. Optionally, the player is limited to placing chips on the wagering layout 200, while the selector 300 and wheel 100 are handled by a dealer or croupier.

After all wagers have been received, the dealer or croupier spins the wheel 100 and releases 804 the selector 300 into the wheel 100. Optionally, the selector 300 is propelled into the wheel 100 in a direction opposite to the rotation of the wheel 100. When the selector 300 indexes, i.e. comes to rest, in a pocket 102, a determination 806 is made of the game indicium and secondary indicium associated with the pocket 102 and the payout indicator showing on an exposed face 302 of the selector. For example, in the optional embodiment shown in FIGS. 1-7, when the selector 300 comes to rest in a pocket 102, the number and color associated with the pocket 102 and the payout indicator 404 on the upward pentagonal face 302 of the twelve-sided selector 300 are determined. If, for example, the selector 300 comes to rest in the pocket 102 marked "3" with the payout selector 404 of 30 on the upward face 302, the selected game indicium would be "3," the selected color according to the example of Table 1 would be "Blue," and the payout indicator would be 30. Wagers are resolved 808 based on the game indicium 104 (e.g. number), secondary indicium (e.g. color), and payout indicator 404 (e.g. multiplier).

In resolving number wagers, the payout indicator 404 on the designated face of the selector determines, at least in part, the reward issued for winning wagers. For example, where the payout indicator 404 is a multiplier, the reward issued to a player for a correct selection may be determined by multiplying the payout indicator by the amount wagered. Thus, in the example above, a player who wagered $2 on 3 on a numbers wagering area 500, would be paid $60 since the payout indicator 404 on the upward face 302 is 30 (that is, $2×30=$60). Optionally, a reward for a winning wager on a combination of numbers may be reduced (such as halved) compared to the reward for a winning wager on a single number. For example, as discussed above in association with FIGS. 1, 5, and 9, wagers may be received on combinations of numbers. If, in the example above, a player had wagered $2 on the combination of 3 and 6 on a numbers wagering area (and again assuming that the payout indicator is the multiplier 30), the reward may be reduced by half to $30 (that is, $2×30×0.5=$30). Conversely, wagers on all other numbers (that is, the numbers that were not selected) may be collected.

In resolving color wagers, the payout indicator 404 may or may not be considered. For example, in one optional embodiment, the payout indicator 404 is not considered and winning color wagers are always paid at the same rate. Thus, in the example of FIGS. 1, 6, and 9 in which six colors are available for wagering, a winning color wager may be rewarded at five to one. Conversely, wagers on colors not selected may be collected. In the example above, a player wagering $1 on a blue area 604 be paid $5 (that is, $1×5=$5) and wagers on any other colors would be collected.

In resolving payout indicator wagers, the payout indicator 404 may be used to determine which wagers are rewarded, but the payout indicator 404 may or may not be used to determine the amount of the reward. For example, in an optional embodiment, the payout indicator 404 on a designated face 302 (such as the upward face 302) of the selector 300 identifies which payout indicator wagers are rewarded, but the payout indicator wagers are rewarded at a fixed rate. In the example of FIGS. 1-7 and 9 in which six payout indicators may be wagered upon with the distribution of payout indicators 404 including three faces 302 marked 10, three faces 302 marked 20, three faces 302 marked 30, one face 302 marked 40, one face 302 marked 50, and one face 302 marked 100, winning wagers on payout indicators 10, 20, and 30 may be paid at three to one and winning wagers on payout indicators 40, 50, and 100 may be paid at ten to one. In the example above, a wager of $2 on the payout indicator 30 would be paid $6 and wagers on any other payout indicators would be collected.

In resolving all numbers wagers, the payout indicator 404 may or may not be used to determine the payout for a winning wager. For example, in the example of FIGS. 1, 6, and 9, the payout indicator 404 may determine whether the all numbers wager is a winning wager, but all winning wagers may be rewarded at a fixed rate. In the example of FIGS. 1, 6, and 9 in which the distribution of the payout indicators 404 favors 10, 20, and 30, all numbers wagers may be at least partially collected if the payout indicator 404 on a designated face 302 of the selector 300 is 10, 20, or 30 and rewarded if the payout indicator 404 on a designated face 302 of the selector 300 is 40, 50, or 100. Thus, in the example above in which the payout indicator 404 on the upward face 302 of the selector 300 is 30, all wagers on the all numbers area 626 would be collected. However, if, in the example, the payout indicator 404 on the upward face 302 of the selector 300 had been 40, 50, or 100, all wagers on the all numbers area 626 would have been rewarded.

With reference to FIGS. 1, 7, and 9, in resolving wagers on a payout indicator/game indicium combination, the payout indicator 404 may be used to determine, at least in part, the payout for winning wagers. For example, in an optional embodiment, wagers that correctly identify the selected payout indicator 404 and game indicium 104 may be increased (such as doubled) compared to a conventional numbers wager. In the example above, a player wagering $3 on the combination of the number 35 and the payout indicator 30 may be increased to double that of a straight numbers wager to $180 (that is, $3×30×2=$180). Conversely, wagers on any other combinations, regardless of whether the wager incorrectly predicted the payout indicator, the game indicium, or both, would be collected.

While certain embodiments of the present invention have been shown and described it is to be understood that the present invention is subject to many modifications and changes without departing from the spirit and scope of the invention presented herein.

We claim:

1. A method for conducting a wagering game for at least one player using a polygonal selector having a plurality of faces, each of said plurality of said faces adapted to display a payout indicator, a rotatable wheel having a plurality of pockets each of which is associated with a game indicium, said pockets shaped to receive said polygonal selector, and a wagering layout including wagering areas, said wagering layout adapted to receive a wager on at least one of (a) a game indicium and (b) a group of game indicia, the method comprising:

receiving wagers from said at least one player with each wager designating on said wagering layout at least one of (a) a game indicium and (b) a group of game indicia;

randomly selecting a game indicium by spinning said wheel and introducing said polygonal selector into said spinning wheel, said game indicium associated with the pocket in which said polygonal selector comes to rest being the selected game indicium;

determining a reward for any wagers designating said selected game indicium or a group of game indicia including said selected game indicium, said reward determined based on the wager and the payout indicator, if any, on a designated face of the polygonal selector resting in the pocket of the selected game indicium such that said polygonal selector determines both the game indicium to be rewarded and the amount of said reward; and issuing a reward for any wagers on said selected game indicium or a group of game indicia including said selected game indicum.

2. The method of claim 1 wherein said polygonal selector has at least four faces.

3. The method of claim 2 wherein said polygonal selector is a regular dodecahedron.

4. The method of claim 1 wherein said step of determining said reward comprises multiplying said wager by said payout indicator, if any, displayed on the upward face of the polygonal selector resting in said pocket.

5. The method of claim 1 wherein a plurality of said pockets is associated with a secondary indicium and said wagering layout further includes wagering areas adapted to receive wagers on at least one secondary indicium, said method further comprising:

receiving wagers on at least one secondary indicium; and issuing a reward for wagers designating the secondary indicium associated with the pocket in which said polygonal selector comes to rest.

6. The method of claim 5 wherein said secondary indicium is a color.

7. The method of claim 1 wherein said wagering layout further includes wagering areas adapted to receive wagers on at least one payout indicator and said method further comprises:

receiving wagers on at least one payout indicator; and issuing a reward for wagers designating the payout indicator on a designated face of said polygonal selector when it comes to rest in a pocket.

8. A method for conducting a wagering game for at least one player comprising:

providing a polygonal selector having a plurality of faces, each of said plurality of said faces adapted to display a payout indicator;

providing a rotatable wheel having a plurality of pockets each of which is associated with a game indicium, said pockets shaped to receive said polygonal selector;

providing a wagering layout including wagering areas, said wagering layout adapted to receive a wager on at least one of (a) a game indicium and (b) a group of game indicia;

receiving wagers from said at least one player with each wager designating on said wagering layout at least one of (a) a game indicium and (b) a group of game indicia;

randomly selecting a game indicium by spinning said wheel and introducing said polygonal selector into said spinning wheel, said game indicium associated with the pocket in which said polygonal selector comes to rest being the selected game indicium;

determining a reward for any wagers designating said selected game indicium or a group of game indicia including said selected game indicium, said reward determined based on the wager and the payout indicator, if any, on a designated face of the polygonal selector resting in the pocket of the selected game indicium such that said polygonal selector determines both the game indicium to be rewarded and the amount of said reward; and issuing a reward for any wagers on said selected game indicium or a group of game indicia including said selected game indicum.

9. The method of claim 8 wherein said polygonal selector has at least four faces.

10. The method of claim 9 wherein said polygonal selector is a regular dodecahedron.

11. The method of claim 8 wherein said step of determining said reward comprises multiplying said wager by said payout indicator, if any, displayed on the upward face of the polygonal selector resting in said pocket.

12. The method of claim 8 wherein a plurality of said pockets is associated with a secondary indicium and said wagering layout further includes wagering areas adapted to receive wagers on at least one secondary indicium, said method further comprising:

receiving wagers on at least one secondary indicium; and issuing a reward for wagers designating the secondary indicium associated with the pocket in which said polygonal selector comes to rest.

13. The method of claim 12 wherein said secondary indicium is a color.

14. The method of claim 8 wherein said wagering layout further includes wagering areas adapted to receive wagers on at least one payout indicator and said method further comprises:

receiving wagers on at least one payout indicator; and issuing a reward for wagers designating the payout indicator on a designated face of said polygonal selector when it comes to rest in a pocket.

* * * * *